US008651324B2

(12) United States Patent
Borghi

(10) Patent No.: US 8,651,324 B2
(45) Date of Patent: Feb. 18, 2014

(54) VENDING MACHINE AND METHOD FOR AUTOMATIC DISPENSING OF CONVENIENCE FOOD PRODUCTS

(76) Inventor: Edo Borghi, Reggio Emilia (IT)

( * ) Notice: Subject to any disclaimer, the term of this patent is extended or adjusted under 35 U.S.C. 154(b) by 160 days.

(21) Appl. No.: 13/319,790

(22) PCT Filed: May 10, 2010

(86) PCT No.: PCT/EP2010/056325
§ 371 (c)(1),
(2), (4) Date: Nov. 10, 2011

(87) PCT Pub. No.: WO2010/130670
PCT Pub. Date: Nov. 18, 2010

(65) Prior Publication Data

US 2012/0055950 A1 Mar. 8, 2012

(30) Foreign Application Priority Data

May 11, 2009 (IT) ..... PR2009A0036

(51) Int. Cl.
*G07F 9/10* (2006.01)

(52) U.S. Cl.
USPC ..... 221/150 HC; 221/150 A; 221/150 R

(58) Field of Classification Search
USPC ..... 221/150 HC, 150 A, 150 R
See application file for complete search history.

(56) References Cited

U.S. PATENT DOCUMENTS 4,671,425 A * 6/1987 Knoll ..... 221/150 HC
4,687,119 A * 8/1987 Juillet ..... 221/150 HC
5,168,795 A * 12/1992 Okada ..... 221/150 HC
5,245,150 A * 9/1993 Grandi ..... 221/150 HC
5,566,856 A * 10/1996 Fallen et al. ..... 221/150 HC
6,550,632 B2 * 4/2003 Gubbini et al. ..... 221/150 HC
7,137,529 B2 * 11/2006 Martinelli et al. ..... 221/150 HC
7,303,093 B2 * 12/2007 Ward ..... 221/150 HC

FOREIGN PATENT DOCUMENTS

| | | |
|---|---|---|
| DE | 34 12 899 | 10/1985 |
| EP | 0 157 245 | 10/1985 |
| WO | 02/091317 | 11/2002 |
| WO | 2004/023408 | 3/2004 |

OTHER PUBLICATIONS

International Search Report dated Aug. 16, 2010, corresponding to PCT/EP2010/056325.

* cited by examiner

*Primary Examiner* — Timothy Waggoner
(74) *Attorney, Agent, or Firm* — Young & Thompson

(57) ABSTRACT

A vending machine for dispensing convenience food products, picked up from a special refrigerated storage compartment, and delivered to an appropriate manual pick-up area. Its structure defines isolated areas communicating by a door; the first area being designed for containment of the products to be dispensed, the second area being designed for handling, picking up and dispensing of the product picked up from the area. The pick-up and delivery area includes a turret having an element for supporting a door adapted to seal and close a corresponding opening of a partition between the areas and; the door rotating with the structure of the turret, as it moves away from the opening, and at least one element for containing the product to be delivered, which is adapted to longitudinally slide along the turret and be opened by a loading and unloading door; the enclosure being displaced by a translating element.

16 Claims, 17 Drawing Sheets

VENDING MACHINE AND METHOD FOR AUTOMATIC DISPENSING OF CONVENIENCE FOOD PRODUCTS

The invention relates to an automatic apparatus for automatic dispensing of convenience and/or packaged food, food products in general, including ready-to-eat fruits and vegetables.

The invention also relates to the method of picking up, depositing and possibly heating or cooking the packaged food product.

A first object of the invention is to provide an apparatus comprising two isolated, adjacent areas, that can be caused to communicate with each other by means of appropriate openings and rotary systems: while the first area is designed for low-temperature storage of the packaged products, the second area consists of a handling turret comprising means for picking up the packaged product and depositing it into a special discharge and manual pick-up area.

A second object is associated with the possibility of cooking and/or heating, if needed, the picked up product by means such as electric or microwave ovens.

The electric or microwave ovens are located at the product discharge station whereby, prior to the door being opened for manual pick-up, the oven can heat the product to the desired temperature.

The product cooking/heating process will be obviously monitored by devices for controlling temperature or the amount of heat/power delivered.

A further object implemented by the present machine is to heat and possibly cook the product while it is being moved, i.e. after picking up thereof from the storage compartment. Therefore, the present machine delivers heat at least as the product moves along the product handling turret. If the handling time is shorter than needed, heat will be obviously delivered even when the product has already reached its destination, with the manual pick-up doors being held closed for the appropriate time.

A further object is to deliver heat to the picked up product by means of an oven comprising a magnetron and a microwave stirrer.

Another object of the invention is to provide an apparatus that can either cause the product to be heated during its downward movement or only ensure its downward movement and heat it later, once it has reached the deposit area.

Also, a further object is to provide a system for removing the product from the oven by sliding pick-up means whose reciprocating sliding motion is ensured by appropriate mechanisms.

Finally, another object of the invention is to provide an improved device for opening the refrigerated storage compartment associated with the column of the pick-up and heating oven, as well as improved thermal flow in the refrigerated storage compartment of the vending machine.

The advantages provided by the present method include:

- Smaller size of the handling area, affording either reduction of the machine size or enlargement of the refrigerated storage compartment, for increased containment space for convenience food,
- A convenience food displacement system that uses a rotary turret, with the refrigerated storage compartment being opened while the heating column/turret moves, which reduces the number of mechanisms required for operation of the machine and also prevents interference of multiple mechanisms,
- A fork ejection/pick-up system, which minimizes the size of the mechanism,

- The possibility of heating the product at the same time as the latter is being moved, which can reduce product delivery time from selection to pick-up,
- Efficient placement of the openings of the enclosure/oven and its mechanisms for uniform heating (stirrer), which greatly affects the operation of the microwave vector, as any change in the geometry and position of the wave emission and reflection sources causes a change in heating efficiency;
- Single-door access, affording minimized heat/microwave losses and easier sealing of the opening.

These objects and advantages are achieved by the method of dispensing precooked products and a dispensing apparatus that implements such method, according to the present invention, which is characterized by the annexed claims.

BRIEF DESCRIPTION OF THE FIGURES

This and other features will be more apparent from the following description of a few embodiments, which are shown by way of example and without limitation in the accompanying drawings.

DESCRIPTION OF THE INVENTION AND EMBODIMENT

Figure 1:
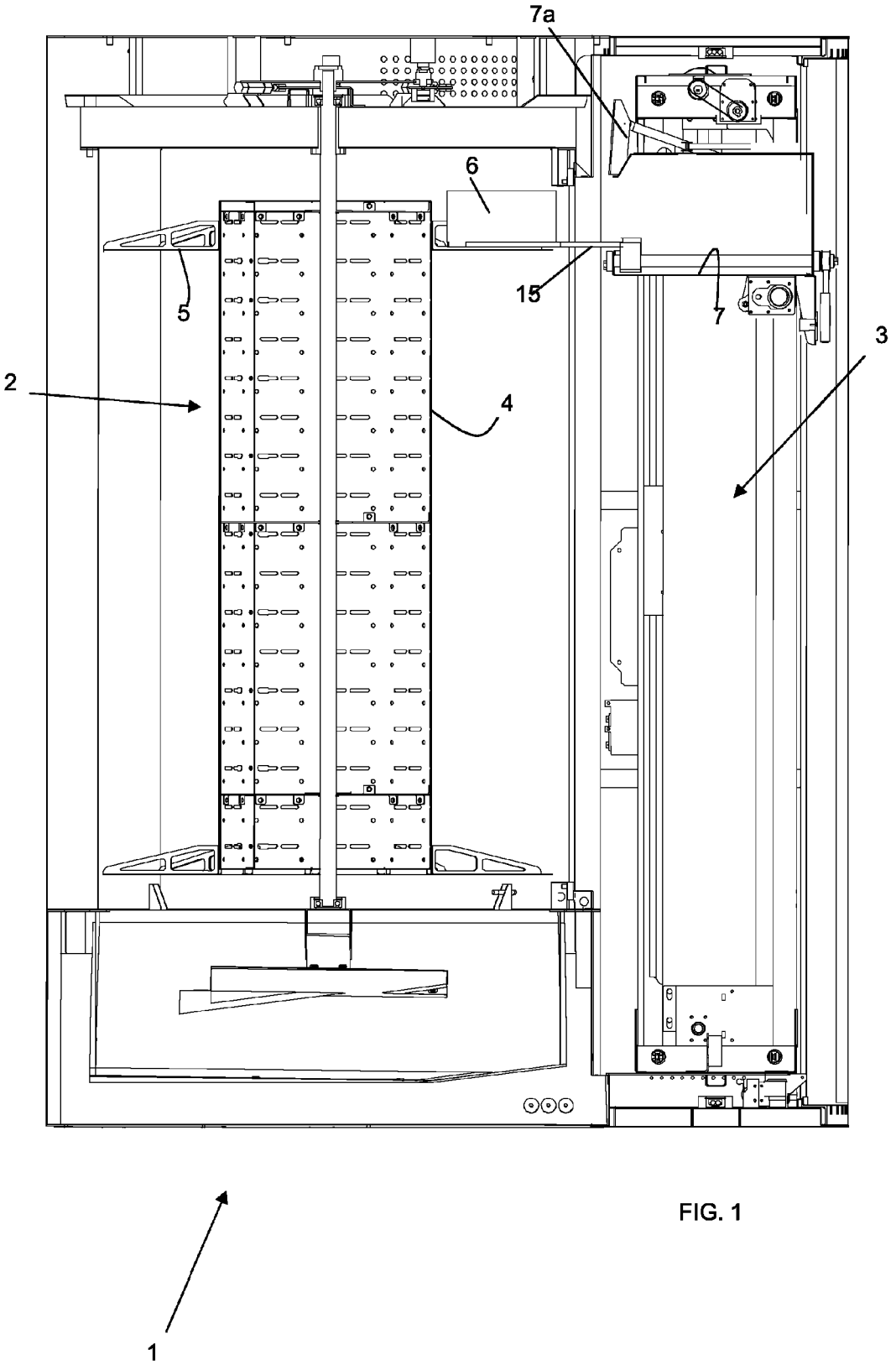
FIG. 1: an interior view of the product handling area of the present vending machine, in a product pick-up position.
Figure 2:
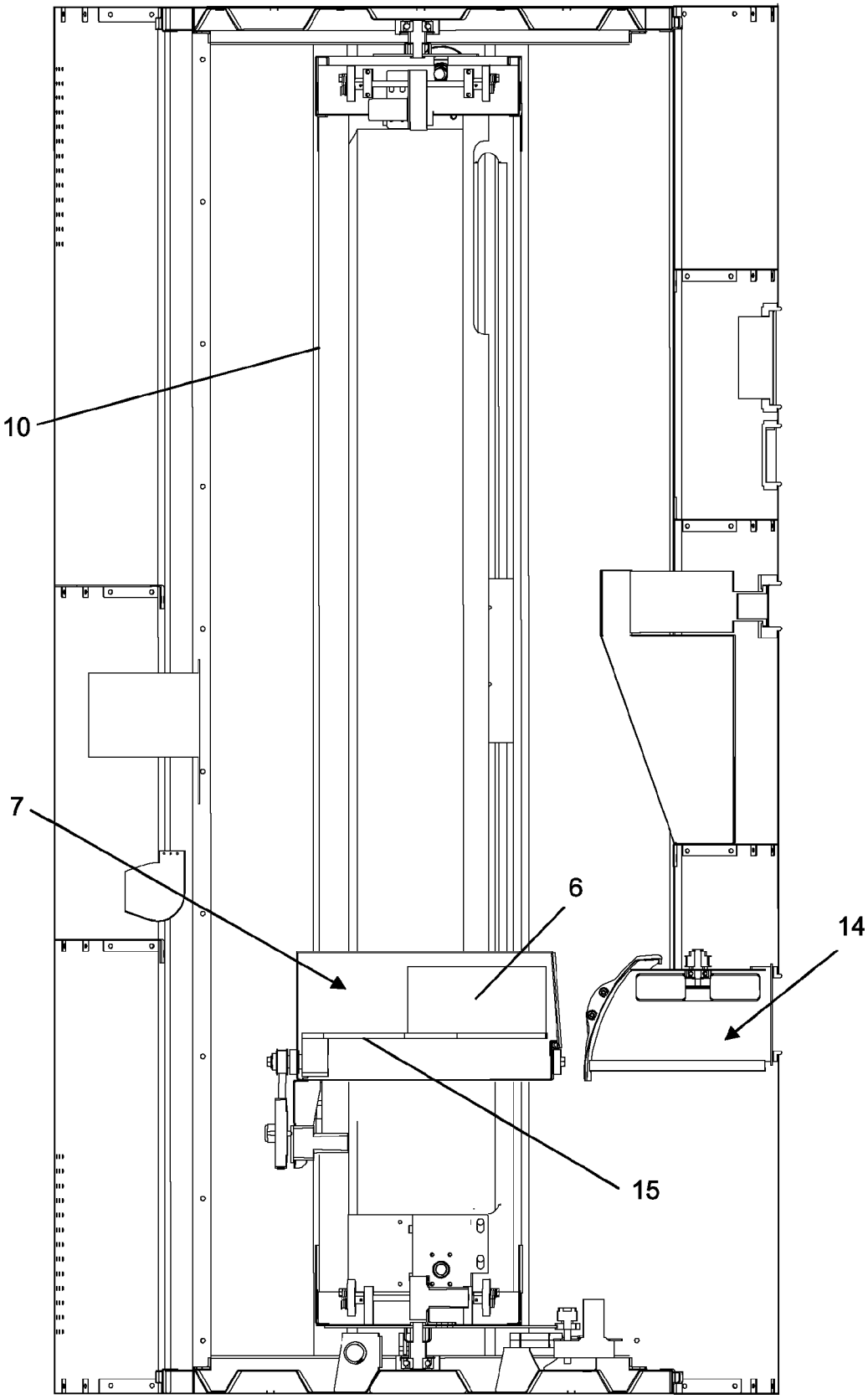
FIG. 2: an interior view of the product handling area of the present vending machine, in a product discharge position.

A few embodiments of a vending machine for convenience/packaged food products will be described above, particularly referring to FIGS. 1 to 15.

Numeral 1 generally designates a vending machine comprising a substantially vertical structure with two areas defined therein, i.e. an area, designated by numeral 2 that acts as a refrigerated storage compartment, and an area designated by numeral 3 that acts as a convenience food pick-up and delivery area. These areas 2 and 3 are adjacent and independent, as described below.

The refrigerated storage or fridge area 2 comprises a rotating support (4) having a plurality of shelves 5 in turn supporting the products 6 (convenience, fresh, prepackaged or precooked food) to be delivered: therefore, this is the refrigerated storage compartment of the vending machine.

Each support 5 has longitudinal openings 5A that are used for the system as described below to pick up the product 6.

On the other hand, the area 3 contains the whole product translating equipment, including the equipment for ensuring heating while the product is being moved, to implement the above described method.

Figure 7:
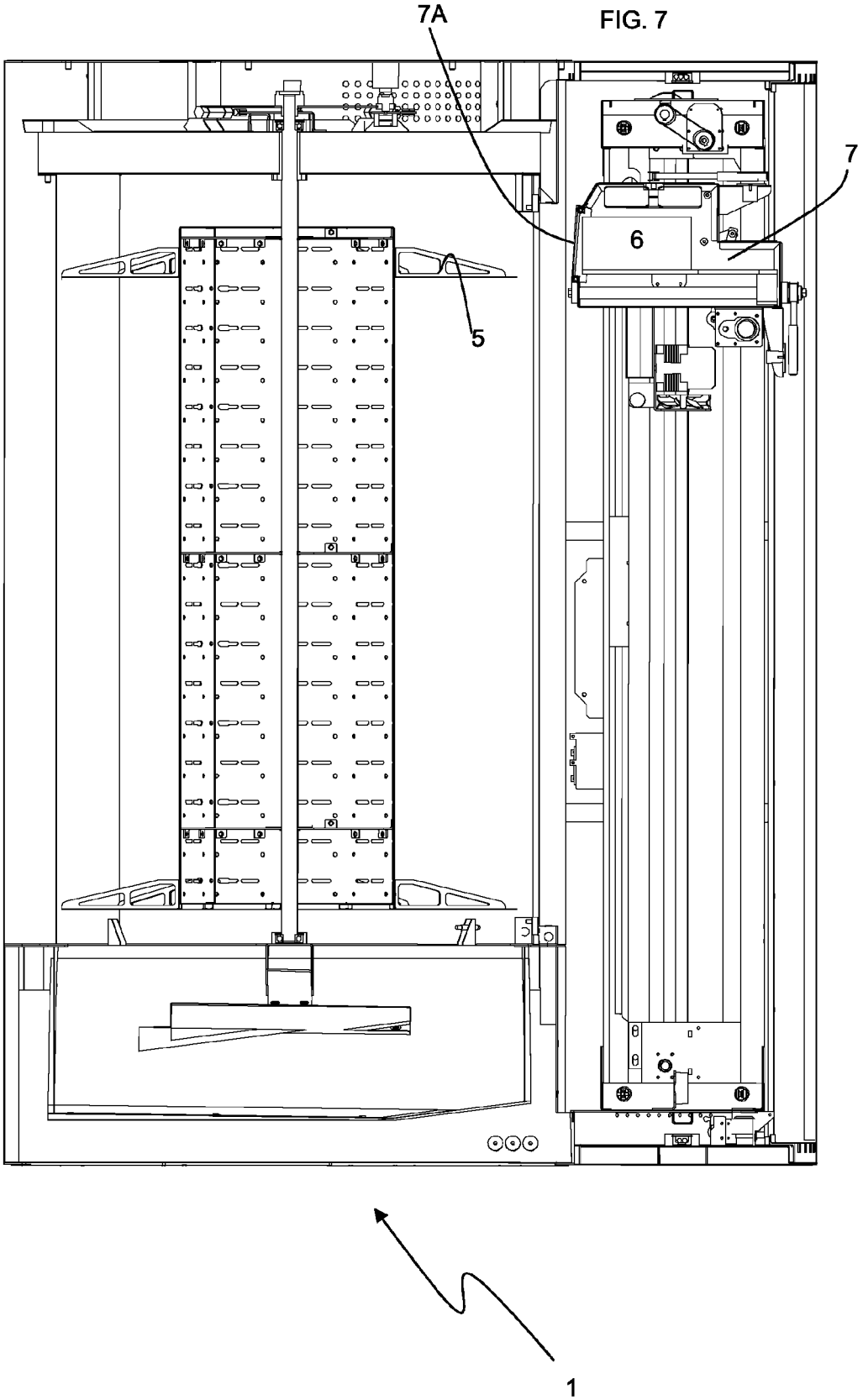
FIG. 7: an interior view of the vending machine that implements the method of the invention, with the product held in the delivery enclosure.
Figure 8:
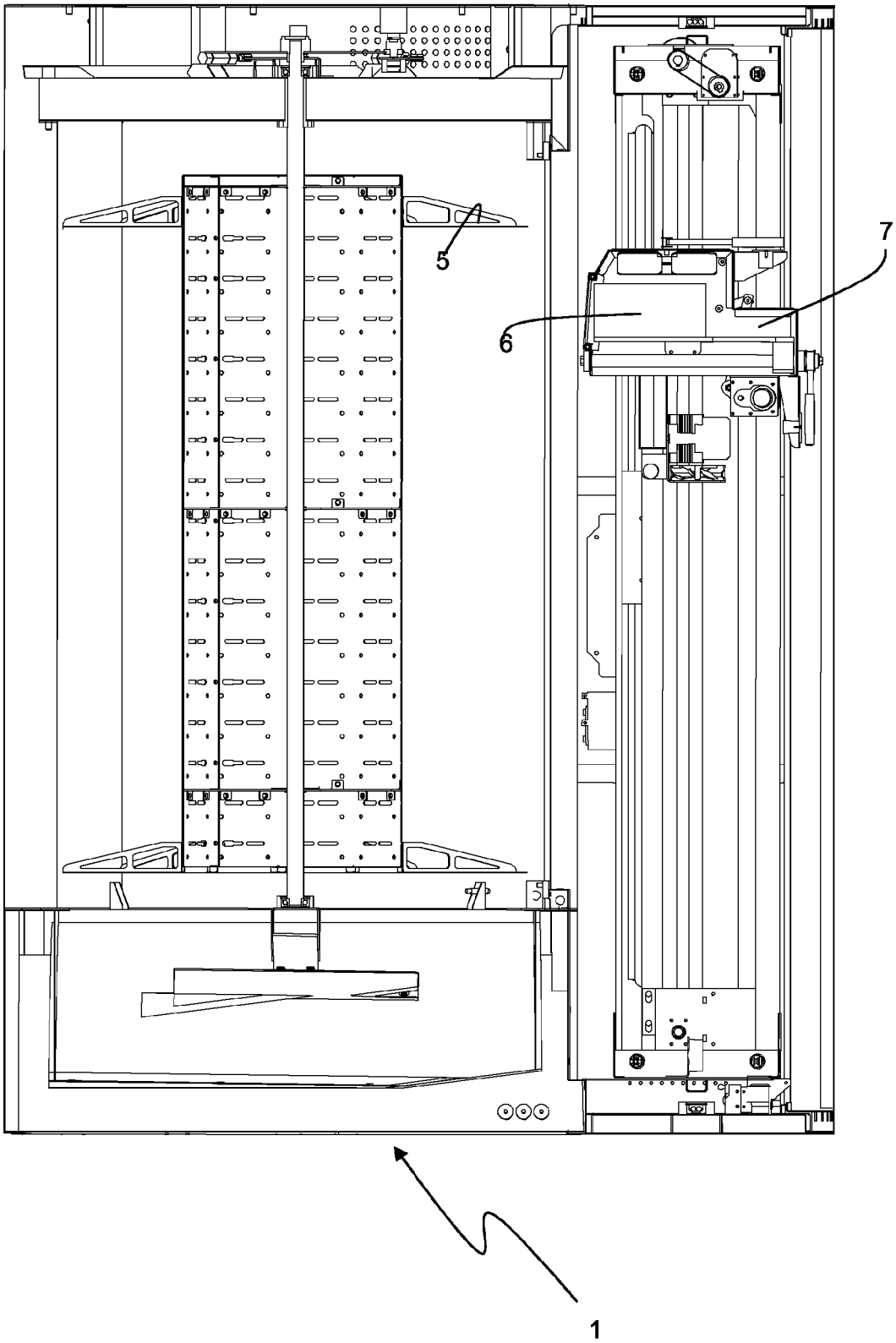
FIG. 8: a displacement, here a downward displacement step.
Figure 9:
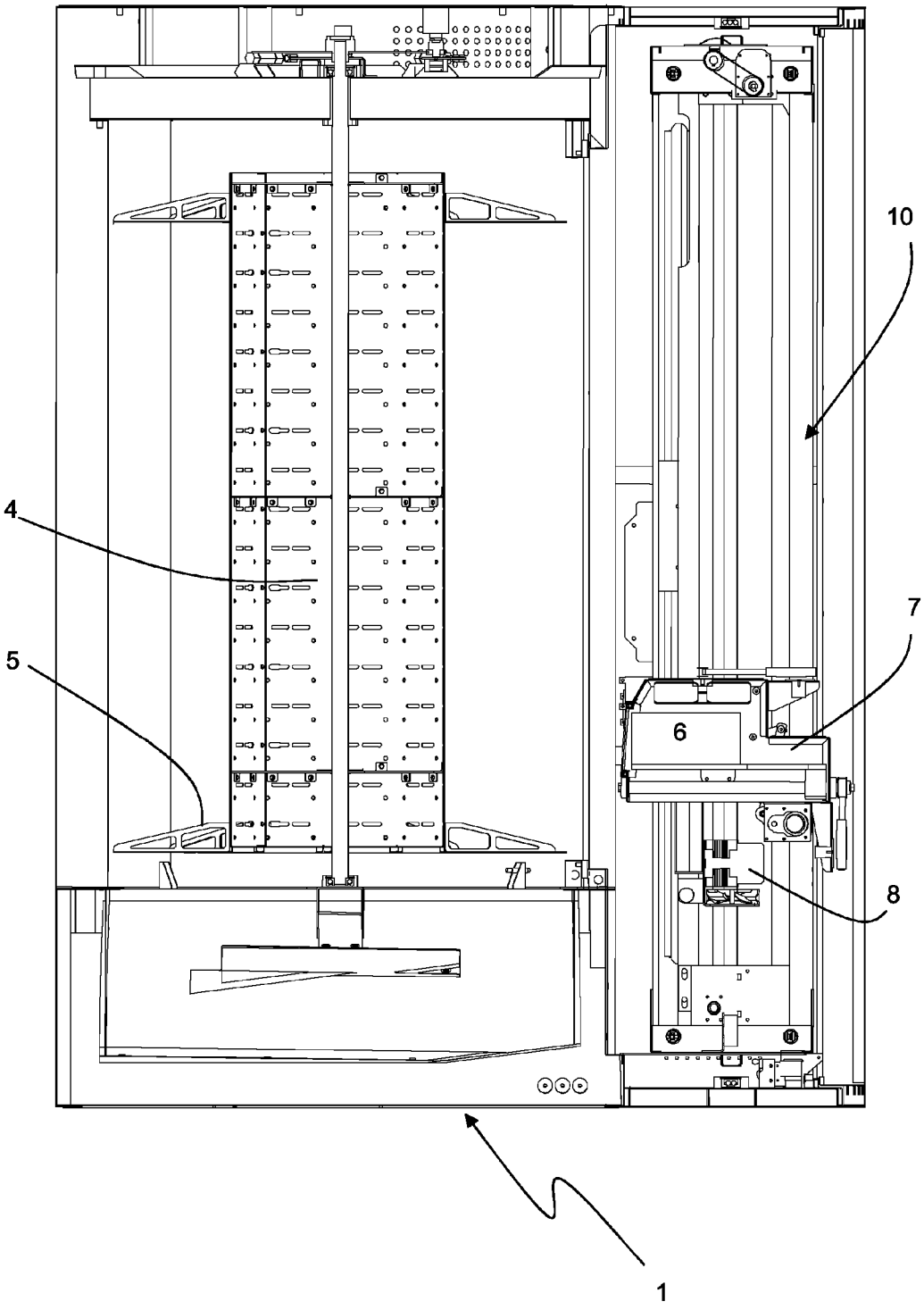
FIG. 9: convenience food delivery step.
Figure 10:
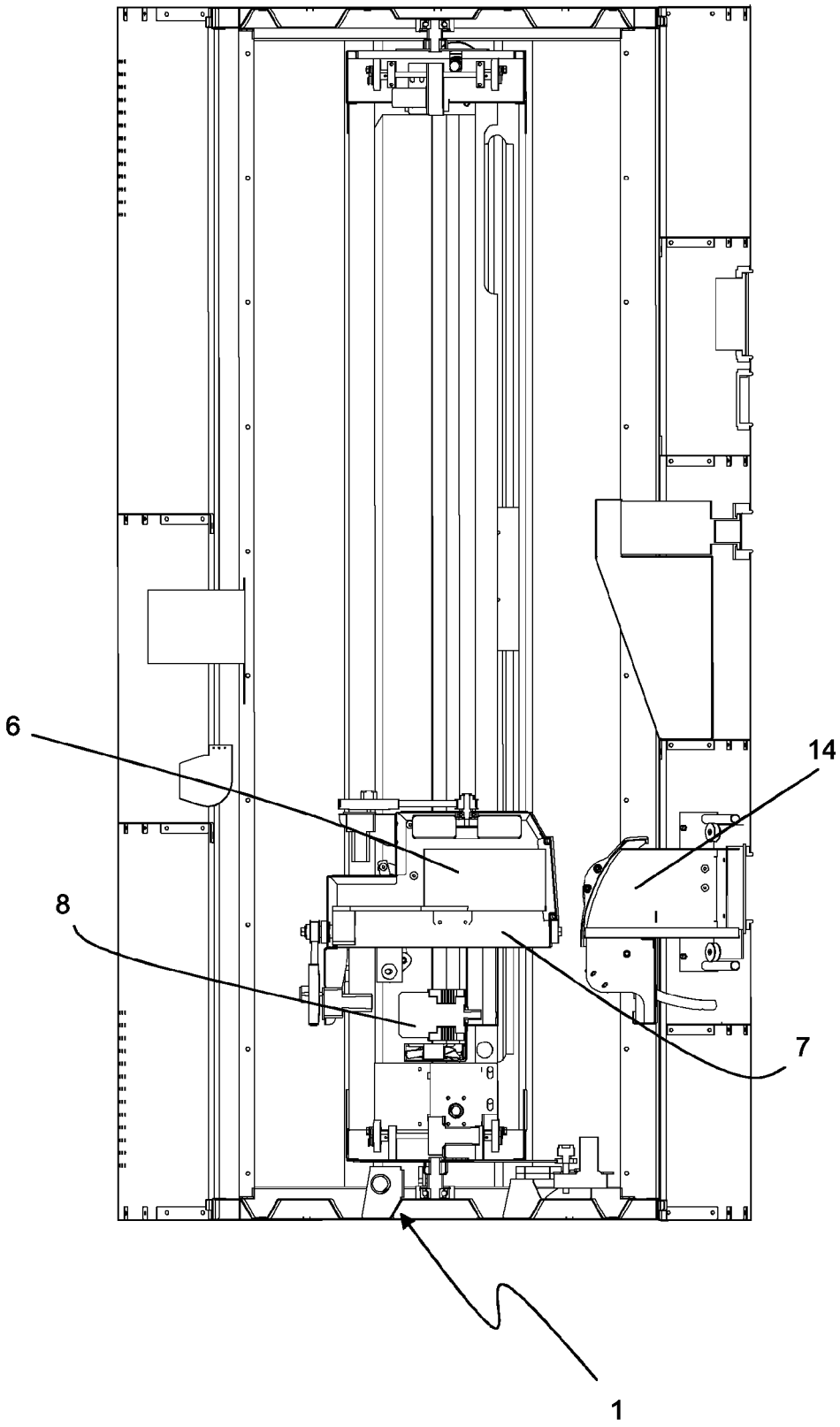
FIG. 10: an additional view of the step of FIG. 9, FIG. 11: a view of the opening and product pick-up and displacement turret.
Figure 11:
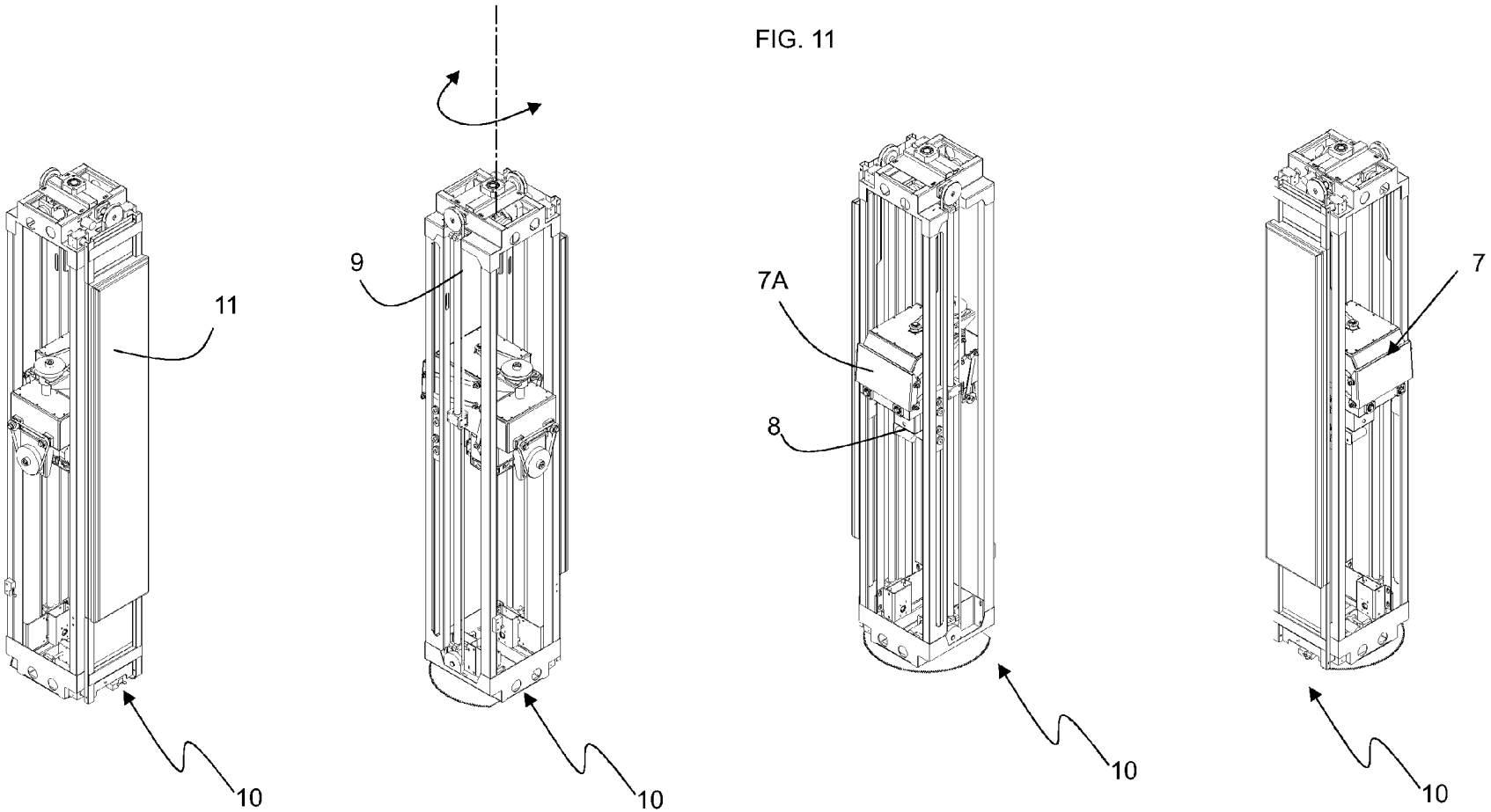
Figure 12:
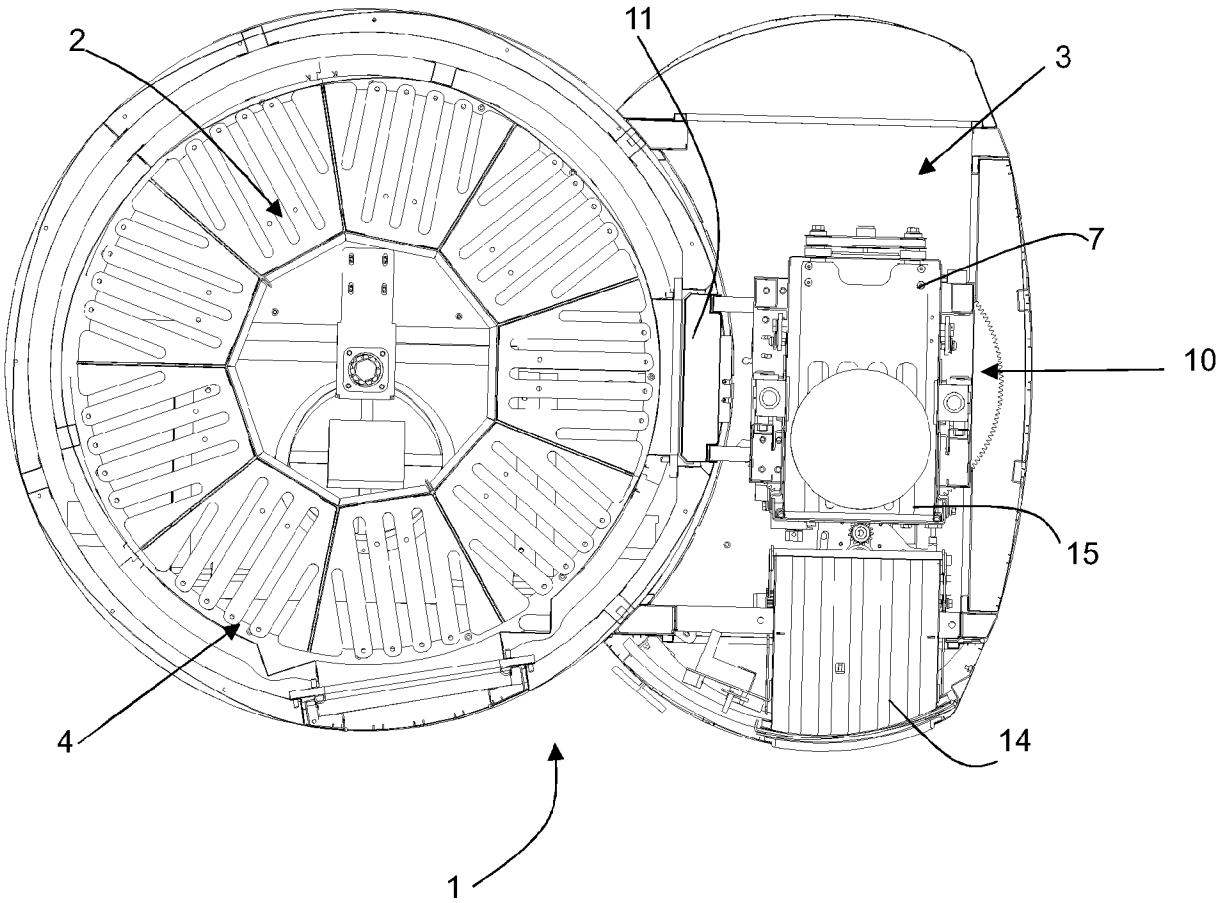
FIG. 12: a top view of the machine of FIG. 5 with the refrigerated storage compartment in a closed and isolated state.
Figure 13:
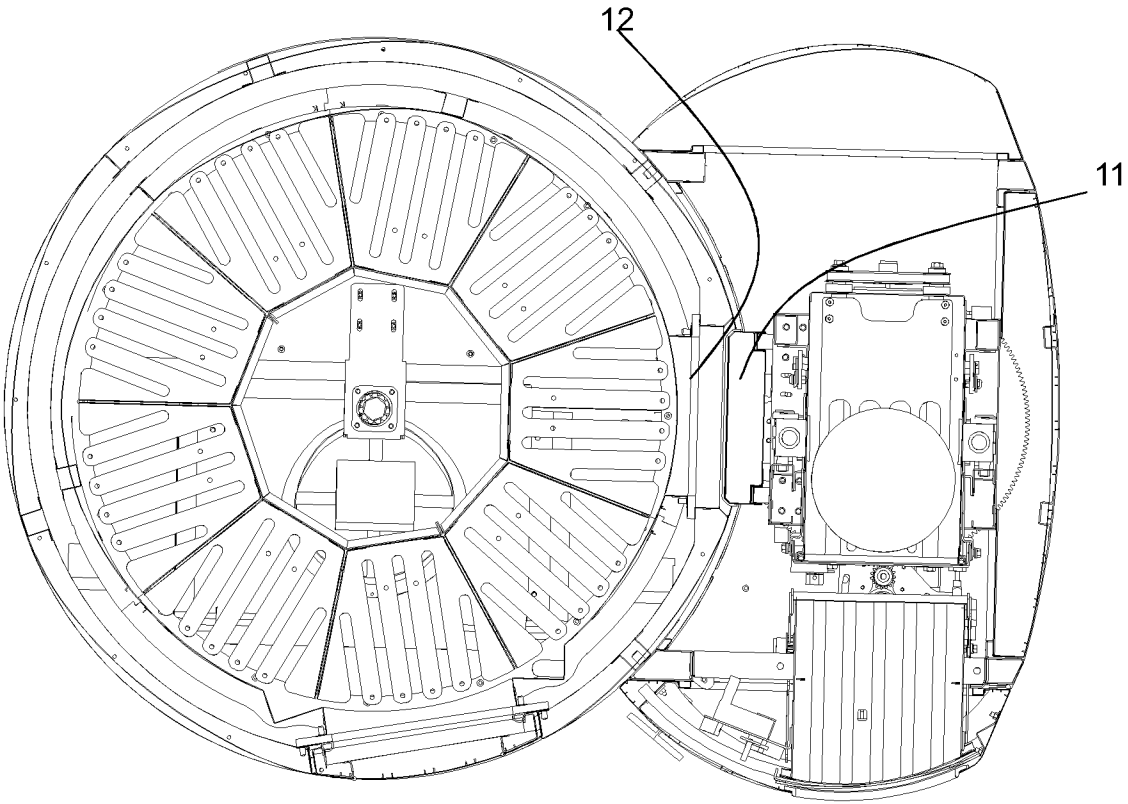
FIG. 13: a top view of the machine of FIG. 12 with the refrigerated storage compartment opened by the pick-up turret.

Namely, in the detailed view of FIG. 7, the area 3 comprises the means for containing the product 6 to be delivered, which is formed of a closed enclosure 7, designed to be opened by the loading and unloading door 7A. This enclosure is adapted to be moved by means 9 of known type, such as belts, chains, etc. thereby acting as an elevator/lowerator.

The above is generally designated by numeral 10, which indicates a product handling turret. Such turret is rotatable, in that it can rotate about its vertical axis, as shown in FIGS. 10, 13, 14 and 15 and has a door 11 fixed to support means, for sealing and closing a corresponding opening that divides the area 2 from the area 3.

Figure 6:
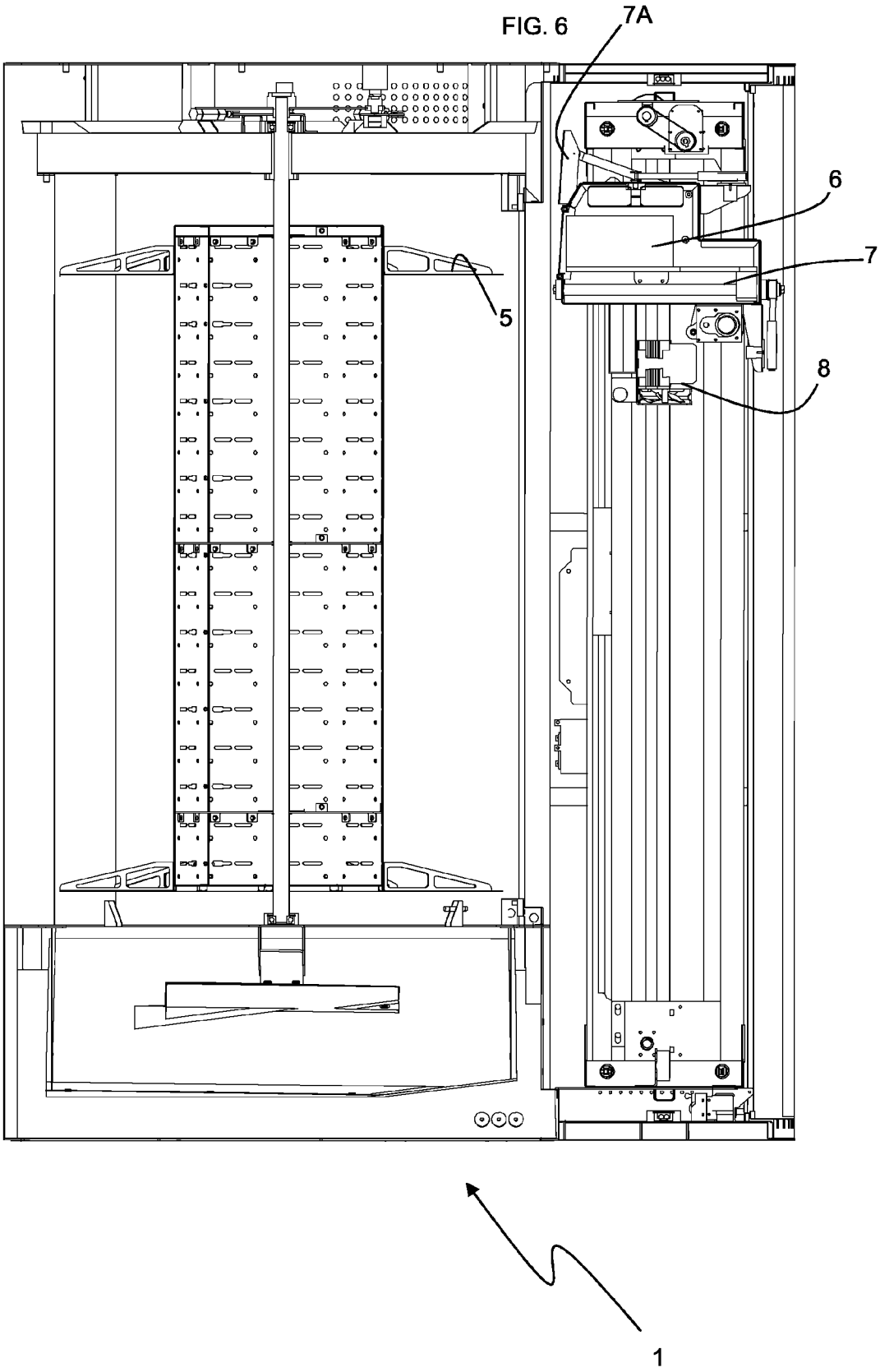
FIG. 6: an interior view of the vending machine that implements the method of the invention in a step and position in which the product is loaded into its support for displacement to the delivery area.

In practice, the storage compartment 2 is closed and the product 6 is picked up by the same turret 10 using drive means of any type which rotate the turret 10, as the door 11 is returned to the corresponding seat/opening (designated by numeral 12 in FIG. 13) of the storage compartment 2, while moving the door 7A of the enclosure 7 to said opening, whereupon (see FIGS. 5 to 10) the product is picked up, moved and delivered to a special manual pick-up area, designated by numeral 14 in FIG. 6. In other words, the refrigerated storage compartment is opened using an insulating door that rotates with the column 10 that contains the enclosure 7 and its drive means.

While reference has been made in this embodiment to a downward direction of movement and delivery of products, product discharge might also occur at higher levels, at a center level or at the top of the present vending machine, without departure from the scope of the invention.

Figure 3:
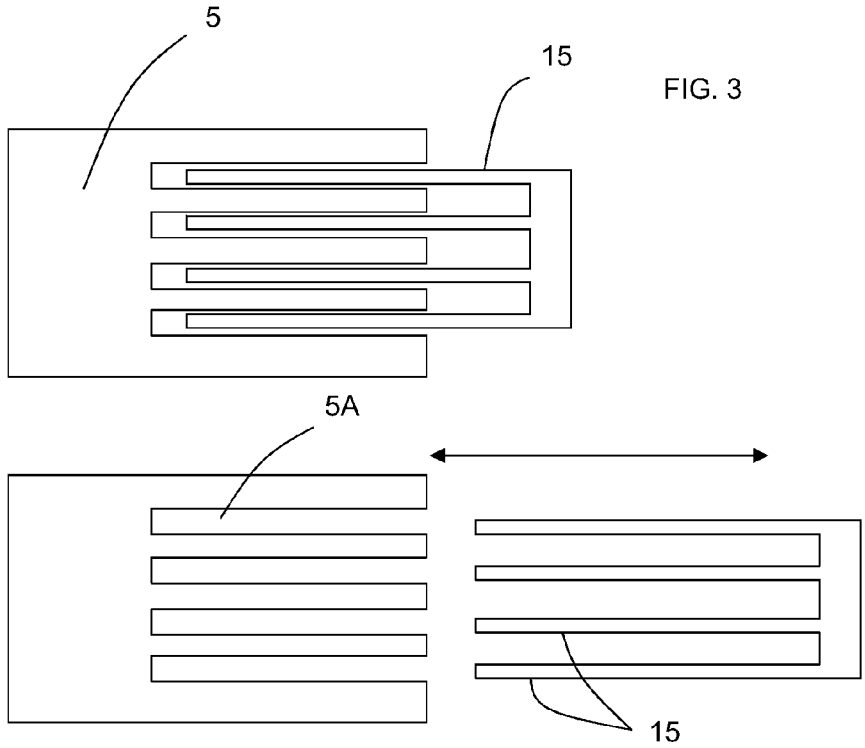
FIG. 3: a plan view of the pick-up and discharge system associated with the handling turret.
Figure 3A:
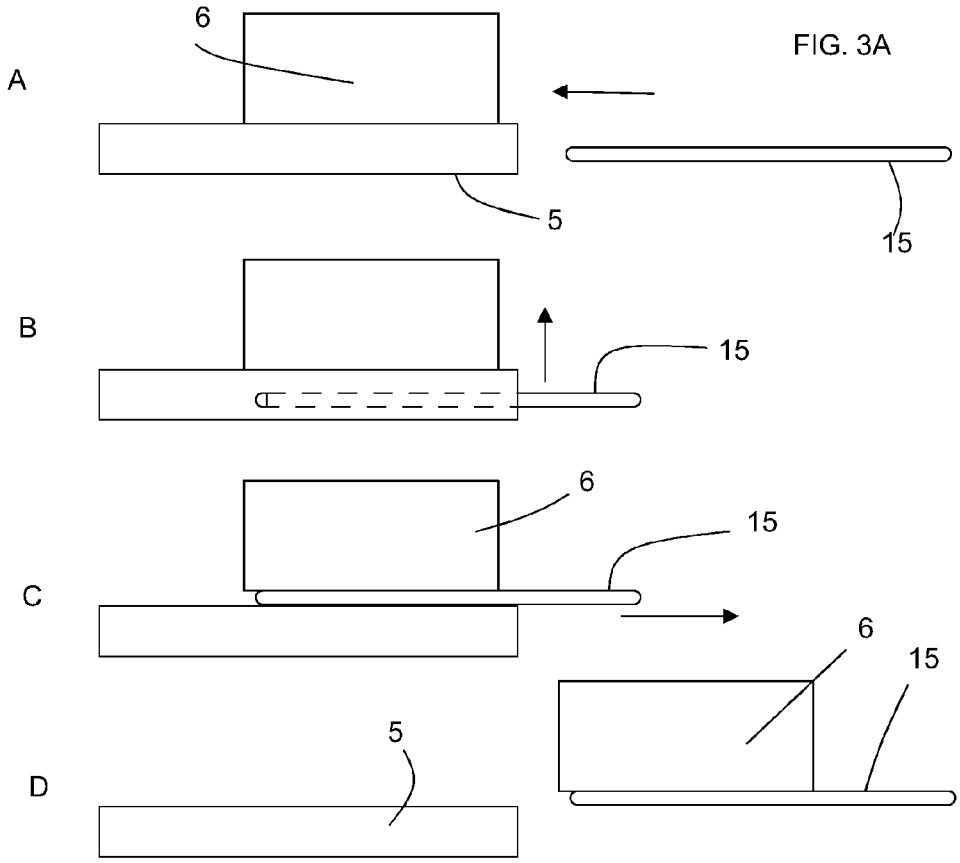
FIG. 3A: the steps carried out by the pick-up and discharge system.

The enclosure 7 advantageously includes a loading and unloading system, which is also shown in detail in FIGS. 3 and 3A; the system has tines 15 that can be moved by handling means allowing a reciprocating sliding movement thereof (in the direction of the arrow of FIG. 3), so that the product may be moved into the enclosure 7 or ejected into the delivery area 14.

Particularly, the tines 15 may fit into the above openings 5A of each shelf 5 or similar openings formed in the delivery area 14.

FIG. 3A shows the product pick-up sequence (a contrary sequence will be used for release): tines 15 are introduced into the openings 5A and then lifted, e.g. using the enclosure 7 handling system of the turret; finally, the product in the enclosure is recovered and transferred into the delivery area 14.

The vending machine has been described heretofore in its basic operation, with no heating means associated therewith, for heating the ready-to-use package. For example, this configuration will be particularly useful for a fresh fruit or fresh vegetable vending machine, which requires no heating means, that would only uselessly increase the machine cost.

If the package has to be heated, means are added for providing heat.

These means may be electric ovens.

The means may also be microwave generating ovens.

In a first embodiment, the heating means are placed at the manual pick-up area 14 (i.e. the area in which products are released by the translating means 7); once the product 6 has been deposited in said area, the (electric or microwave) heating means will be operated for as long as needed for adequate heating of the product, whereupon, the door will be controlled to open for manual product removal.

Figure 4:
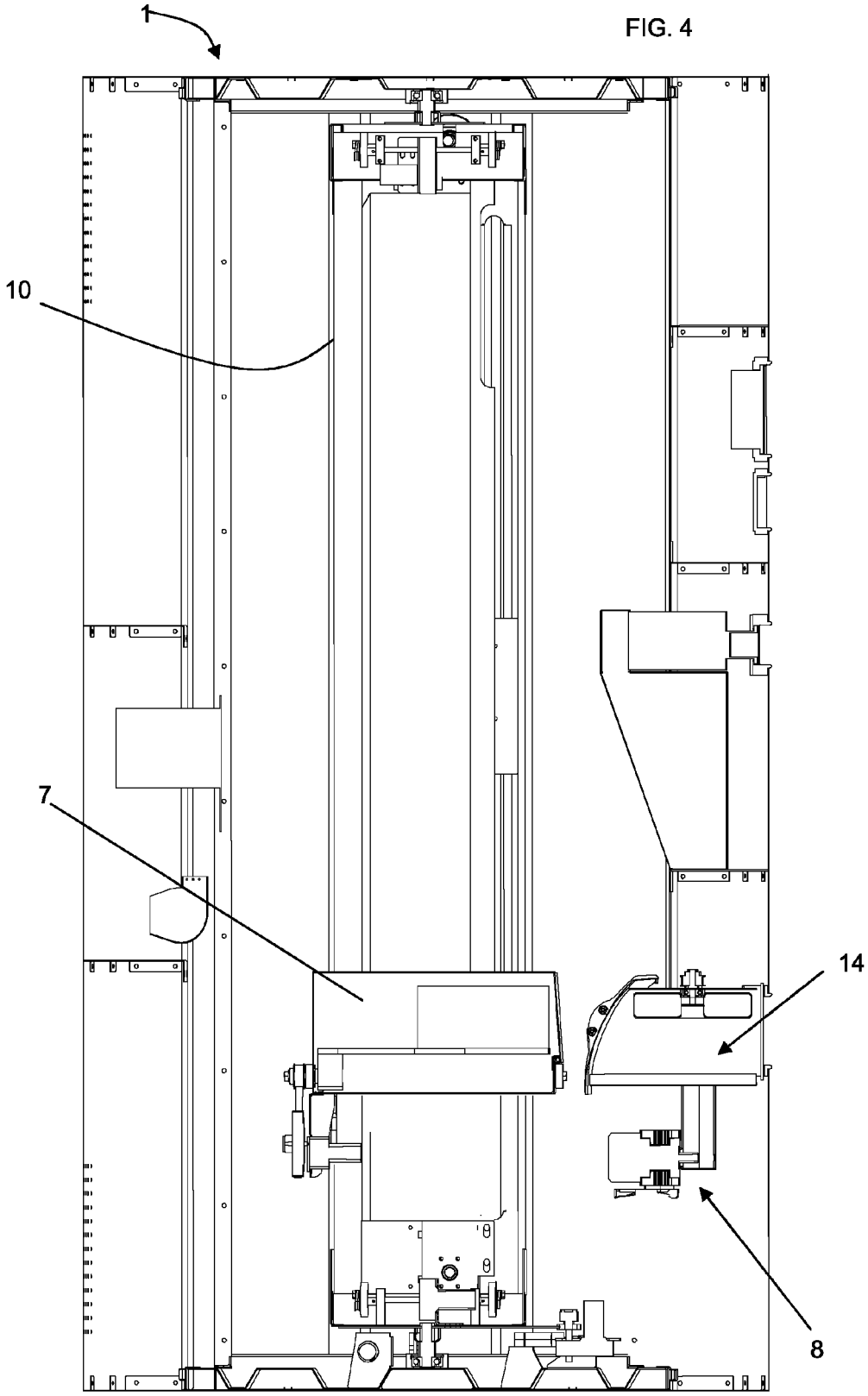
FIG. 4: an interior view of the product handling area of the present vending machine, in a product discharge position, with the discharge area having a heating means, here a microwave system.
Figure 5:
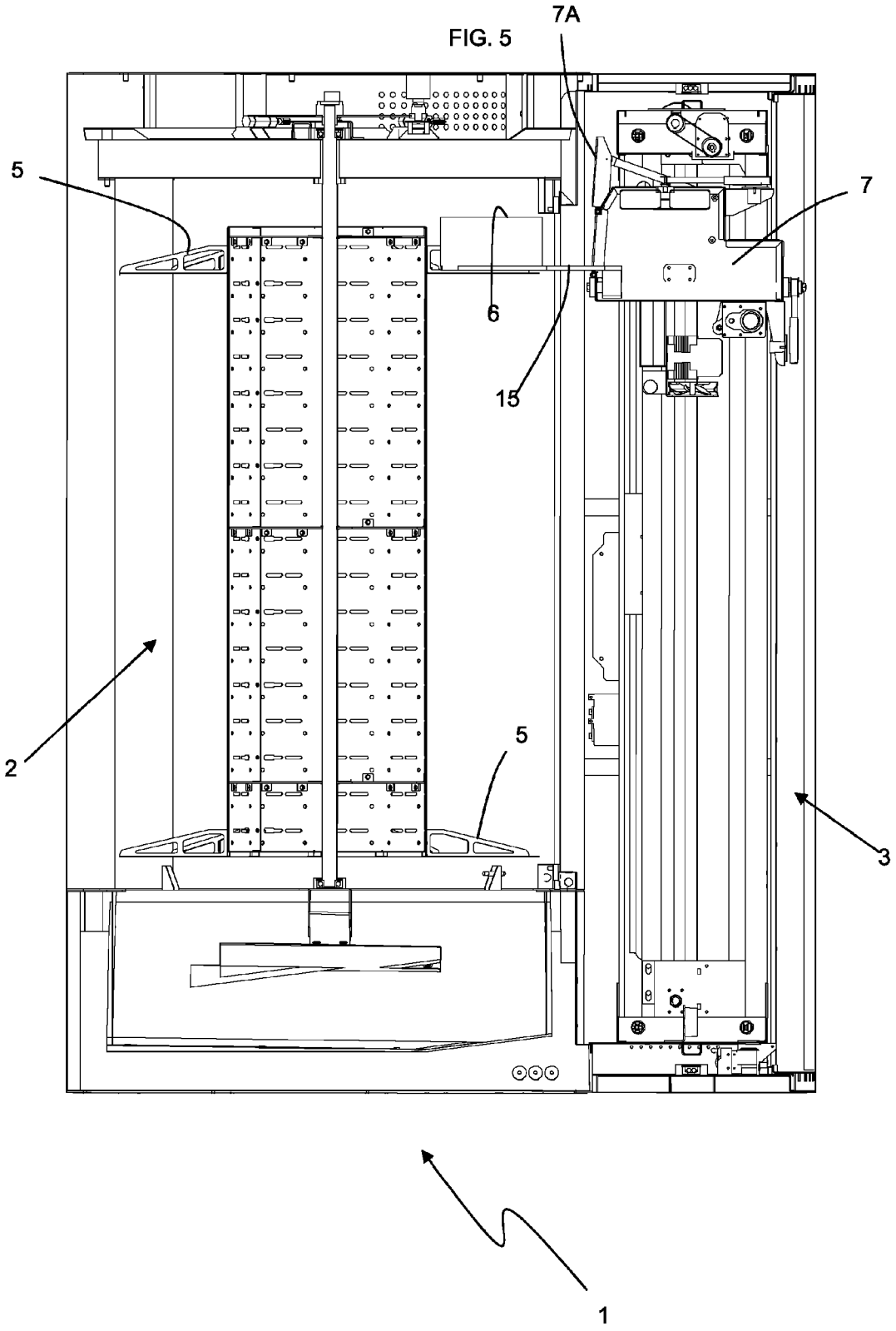
FIG. 5: an interior view of the vending machine that implements the method of the invention in a product pick-up step and position, with the microwave oven in the pick-up enclosure of the turret.

FIG. 4 shows an embodiment of the above application with a microwave heating means (note the presence of a magnetron 8 as also described below) located under the delivery area 14.

In a second variant, the magnetron is located close to (above, below or beside) the translating means 7, also known as convenience food enclosure, to actuate a product heating step, for heating the product picked up from the refrigerated storage compartment, at the same time as the product is transferred, so that, as the product reaches the delivery area, it will be partially or completely heated. This will obviously also be a function of the distance between the pick-up point and the delivery point; in any case, what is intended to be claimed is that product heating is started at least as the product is moved from the refrigerated storage compartment.

Said second variant, i.e. with the magnetron below the enclosure 7 is shown with particular reference to FIGS. 5 to 15.

In practice, the product receives the heat required for heating during the time for completion of the removal and delivery path.

During handling, the product is contained in the enclosure 7 with the oven applied thereto.

The product is heated at least during its movement towards the pick-up area 14, to reach the latter in a partially or completely heated state.

In other words, in this embodiment the enclosure 7 acts as an oven for the product contained therein.

In a first embodiment, the enclosure is equipped with a magnetron 8 and a microwave stirrer, which are adapted to operate and actuate heating by microwave generation.

In a second embodiment, the enclosure is equipped with resistors and electric connections adapted to operate and actuate electric heating.

As mentioned above, vending apparatus generally have a vertical configuration comprising a food carrying turret; therefore motion will preferably occur in the vertical direction, although what is implemented and provided herein may be also implemented with other types/paths of translation of the product to be heated.

A detailed description will be now provided of the refrigerated storage compartment of the vending machine (area designated by numeral 2), with the rotatable support 4 being a structure revolving about a vertical axis; such structure has a plurality of shelves 5 for supporting the products 6 to be delivered attached thereto. The shelves 5 are removable and replaceable for customized configuration of the vending machine at different heights.

Figure 16:
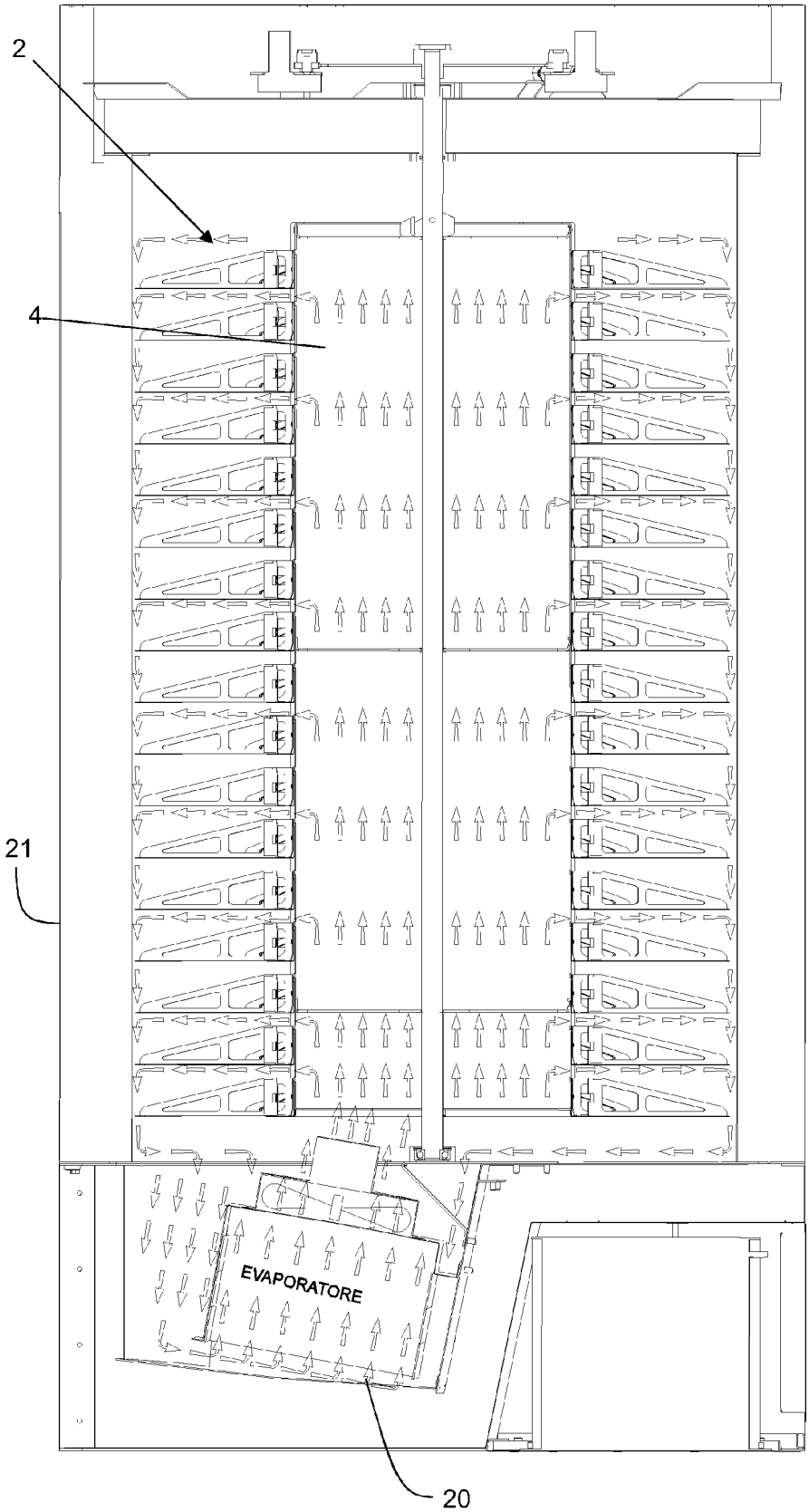
FIG. 16: an elevation view of the interior of the refrigerated storage compartment with the path of the cooling air flow highlighted

As shown in FIG. 16, the rotatable support has a central axial longitudinal opening, closed at its top, and a plurality of through holes between the shelves 5 so that cooling air may be circulated to maintain a stable temperature above or below zero; the air flow is introduced at the center from below and flows throughout the support to come out of the lateral through holes between the shelves 5 and then downwards, where an evaporator means 20 (heat exchanger) restores the flow temperature.

The evaporator 20 has an inclined position, for any condensate to flow towards a single collection point on the bottom.

Figure 17:
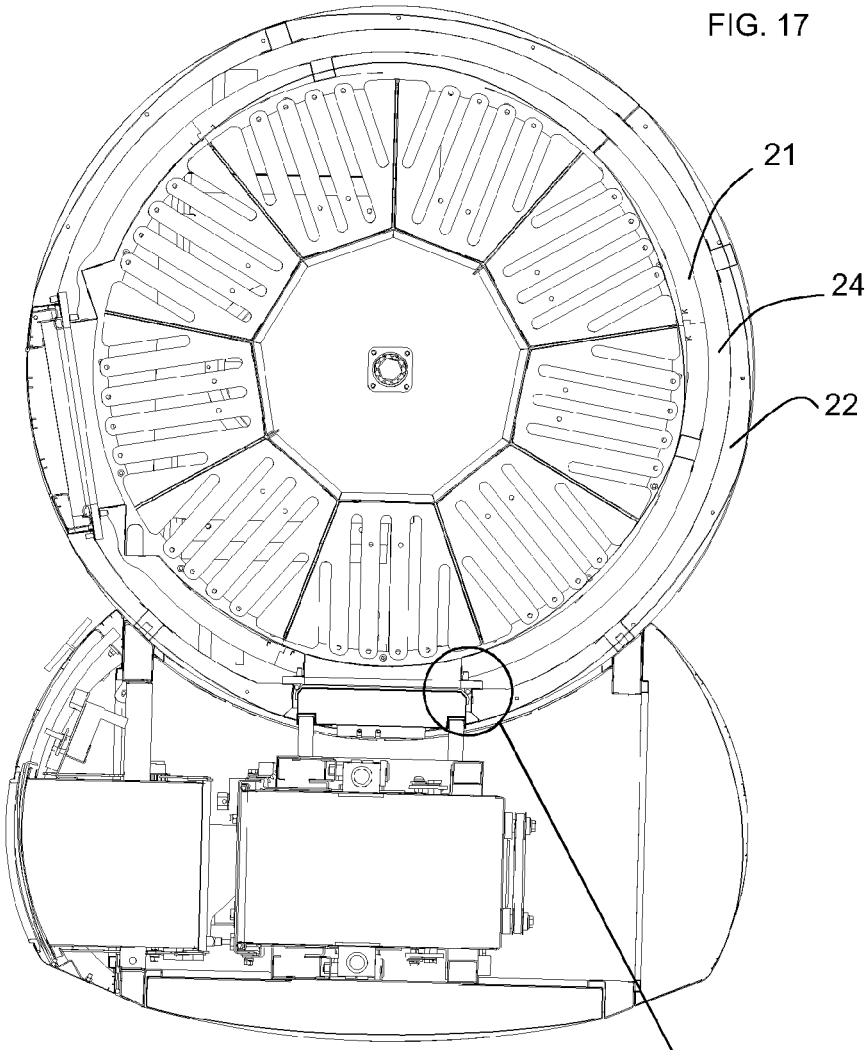
FIG. 17: a top view of the machine
Figure 18:
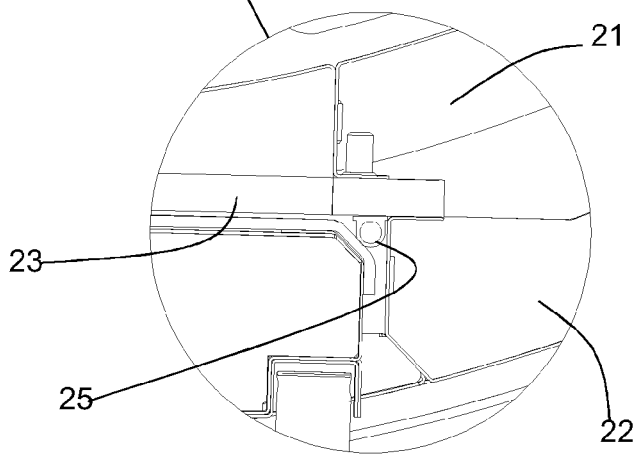
FIG. 18: a detail of the door that closes the turret against the refrigerated storage compartment.

As shown in FIGS. 17 and 18, the column 4 is protected by a first inner case 21 and a second outer case 22, which are coaxial and/or concentric with each other and are insulated by a heat insulator (such as a polyurethane foam or a compound mixture) to be interposed in the cavity 24 created between the two cases 21 and 22.

Figure 14:
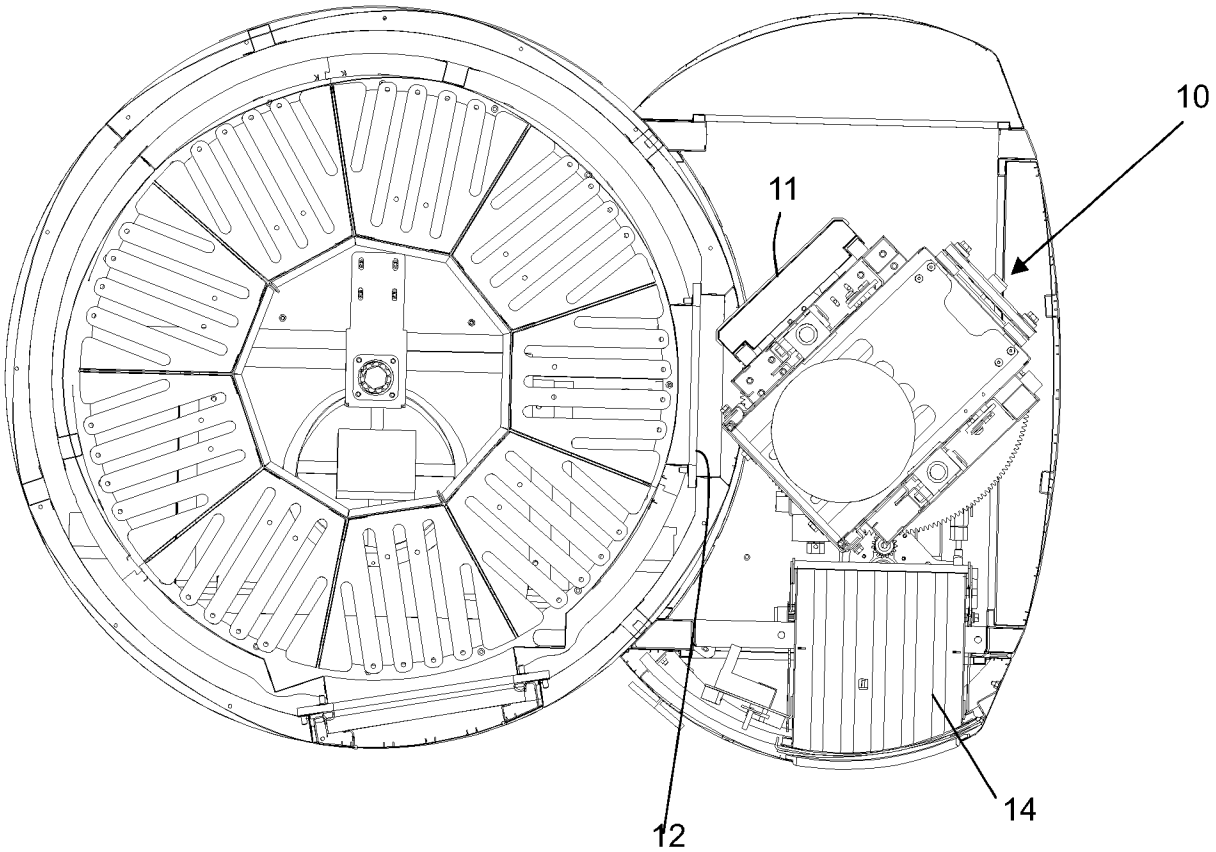
FIG. 14: rotation of the product transferring turret.
Figure 15:
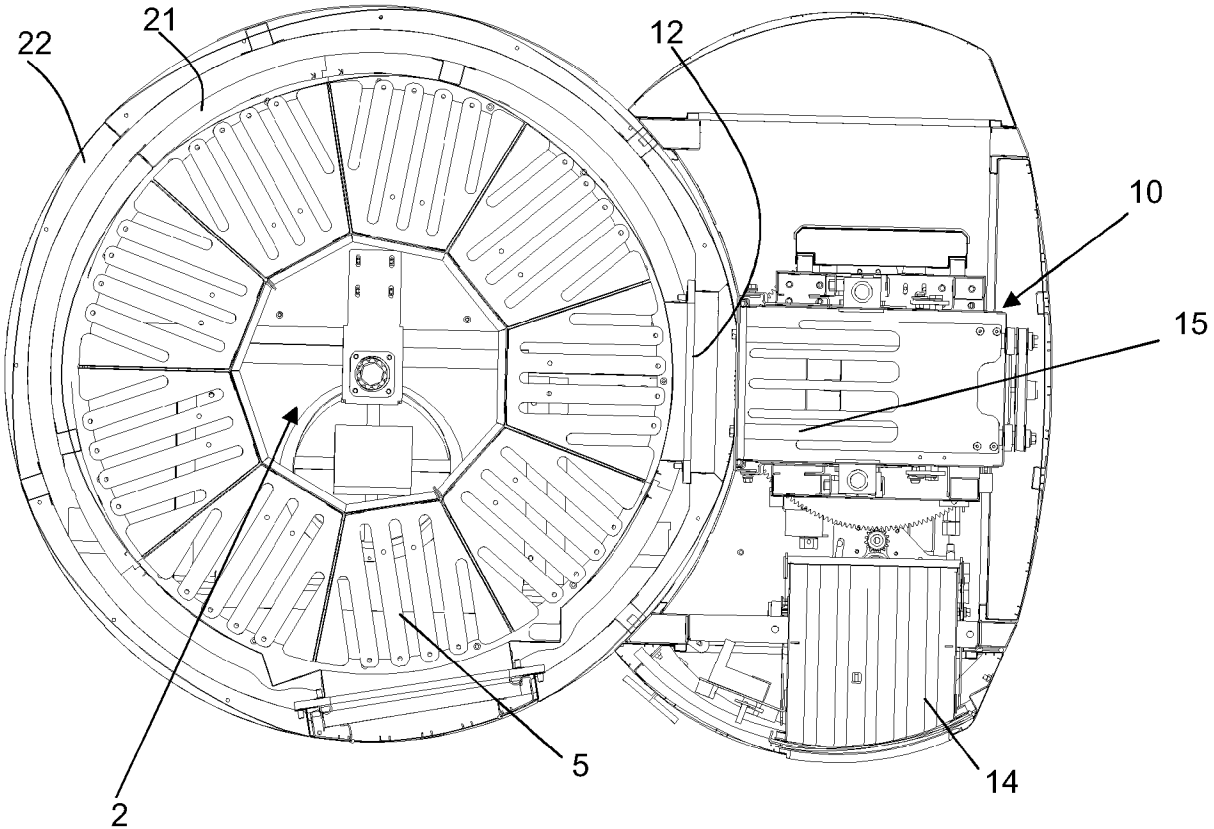
FIG. 15: a top view of the machine of FIG. 12 in a pick-up state.

For further and complete insulation of the refrigerated storage compartment (area 2), a particular arrangement has been added in the proximity of the product loading and pick-up doors, as shown in the detail of FIG. 14.

Namely, proximate to each opening, the inner case is joined to the outer case 22 by an insulating rigid polymeric plate 23 interposed therebetween and a seal 25 attached to the outer side, for ensuring thermal break of the openings.

The seal 25 has a hollow construction for the passage of heating fluid.

The invention claimed is:

1. An apparatus (1) for the distribution of ready-made food/food products (6), comprising:

a structure defining i) a refrigerated first area (2) that contains a product (6) to be distributed, adjacent ii) a second area (3) defining a food pick-up and delivery area, the first area (2) being separated from the second area (3);

a partition that divides the first area (2) from the second area (3), said partition including an opening (12);

a door (11) i) sealing and closing the opening (12) of the partition that divides the first area (2) from the second area (3), and ii) providing communication between said first and second areas (2, 3) so that said second area (3) moves, takes up and delivers the product (6) from said first area (2) into a manual pick-up area (14) of said second area (3);

said food pick-up and delivery area of said second area (3) comprising a turret (10), said door (11) being fixed to said turret (10), said turret (10) and said door (11) being rotatable about a vertical axis, said turret (10) comprising product translating equipment that, via said opening (12), takes up and delivers the product (6) from said first area (2) into said second area (3), said product translating equipment, including a. a closed enclosure (7) openable with a loading and unloading door (7A), the enclosure (7), after movement of the loading and unloading door (7A) to the opening (12), taking up the product from the first area (2) with the product contained within the enclosure (7), and b. a movement element (9) operatively connected to move said enclosure (7) longitudinally sliding along said turret (10).

2. The apparatus (1) according to claim 1, wherein said product translating equipment comprises a plurality of prongs (15) for moving the product (6) which prongs (15) project from said enclosure (7) and are suitable to be inserted within suitable openings arranged below the product (6) for movement of the product (6) into the enclosure (7) or openings in the pick-up area (14) for ejecting the product (6) into the pick-up area (14).

3. The apparatus (1) according to claim 2, further comprising:

an evaporator (20) that provides for recovery of flow temperature, wherein, said first area (2) comprises a pivoting support (4) with a vertical axis revolution structure to which a plurality of product support ledges (5) are removably secured;

said pivoting support being centrally provided with axial opening and comprising a plurality of through holes between the ledges (5) establishing a refrigerating air recirculation; said refrigerating air recirculation being obtained with an airflow which is centrally blown from below and flows throughout the pivoting support until exiting the through holes between the ledges (5) and then flows back downwards where the evaporator (20) provides for the recovery of the flow temperature.

4. The apparatus (1) according to claim 3, wherein, said pivoting structure (4) is protected by casings (21, 22) and insulated by a heat insulator interposed within a gap (24) between said casings (21, 22).

5. The apparatus (1) according to claim 4, wherein said casings are co-axial casings.

6. The apparatus (1) according to claim 3, wherein, said pivoting structure (4) is protected by co-axial and concentric casings (21, 22) and insulated by means of a heat insulator interposed within the a gap (24) between said casings (21, 22);

said co-axial casing is joined to said concentric casing by interposition of a polymeric rigid and insulating plate (23) and a gasket (25), said gasket (25) being provided with cavities for heating fluid to flow therethrough.

7. The apparatus (1) according to claim 3, wherein the evaporator (20) has an inclined position and condensate from the evaporator flows towards a single collection point at a bottom location.

8. The apparatus (1), according to claim 1, wherein, said product translating equipment comprises a heating device located on of above, below, and beside the enclosure (7), said heating device heats the product as the product is being moved within the enclosure (7), and said heating devices being one of i) an electric and ii) a microwave oven.

9. The apparatus (1) according to claim 8, wherein, said product translating equipment comprises a heating device said heating device heating the product within the enclosure (7) at the pick-up area (14) after the product (6) has been deposited in said pick-up area, said heating device being operated for a time required to suitably heat the product, thereafter opening of the loading and unloading door (7A) being commanded to allow for manual withdrawal of the product from the enclosure (7).

10. The apparatus (1) according to claim 8, wherein said heating device is located adjacent to the enclosure (7).

11. The apparatus (1) according to claim 10, further comprising:

said heating device comprises a magnetron (8) and a microwave reflection fan associated to said enclosure.

12. The apparatus (1) according to claim 10, wherein, said heating device comprises an electric heater.

13. The apparatus (1) according to claim 10, wherein, said casings are concentric casings.

14. A method for distributing ready-made food/food products (6), comprising the steps of:

a) operating a structure defining i) a refrigerated first area (2) that contains a product (6) to be distributed, adjacent ii) a second area (3) defining a food pick-up and delivery area, the first area (2) being separated from the second area (3);

a partition that divides the first area (2) from the second area (3), said partition including an opening (12);

a door (11) i) sealing and closing the opening (12)of the partition that divides the first area (2) from the second area (3), and ii) providing communication between said first and second areas (2, 3) so that said second area (3) moves, takes up and delivers the product (6) from said first area (2) into a manual pick-up area (14) of said second area (3);

said food pick-up and delivery area of said second area (3) comprising a turret (10), said door (11) being fixed to said turret (10), said turret (10) and said door (11) being rotatable about a vertical axis, said turret (10) comprising product translating equipment that, via said opening (12), takes up and delivers the product (6) from said first area (2) into said second area (3), said product translating equipment, including a. a closed enclosure (7) openable with a loading and unloading door (7A), the enclosure (7), after movement of the loading and unloading door (7A) to the opening (12), taking up the product from the first area (2) with the product contained within the enclosure (7), and b. a movement element (9) operatively connected to move said enclosure (7) longitudinally sliding along said turret (10);

b) storing the product (6) in the first area (1);

c) rotating the turret (10) to position the enclosure (7) at the opening (12);

d) operating the movement element to move said enclosure (7) longitudinally sliding along said turret (10); and e) taking up from the first area (2) the product (6), heating the product (6) within the enclosure (7) while moving the product (6), and releasing the product, heated, in pick-up area (14).

15. The method according to claim 14, wherein the heating of the product within the enclosure is carried out via a microwave device.

16. The method according to claim 14, wherein the heating of the product within the enclosure is carried out via an electric device.

* * * * *